US007451910B2

(12) United States Patent
Frost et al.

(10) Patent No.: US 7,451,910 B2
(45) Date of Patent: Nov. 18, 2008

(54) CUP MADE OF PAPER MATERIAL

(75) Inventors: Robert Frost, Landshut (DE); Werner Stahlecker, Goeppingen (DE)

(73) Assignee: PTM Packaging Tools Machinery Pte. Ltd., Singapore (SG)

( * ) Notice: Subject to any disclaimer, the term of this patent is extended or adjusted under 35 U.S.C. 154(b) by 0 days.

(21) Appl. No.: 11/879,214

(22) Filed: Jul. 16, 2007

(65) Prior Publication Data

US 2008/0023536 A1 Jan. 31, 2008

(30) Foreign Application Priority Data

Jul. 17, 2006 (DE) ..... 10 2006 034 267
Jun. 25, 2007 (DE) ..... 10 2007 030 864

(51) Int. Cl.
*B65D 21/02* (2006.01)
*B65D 3/22* (2006.01)
*B65D 3/28* (2006.01)

(52) U.S. Cl. ..... 229/400; 206/515; 206/519; 229/403

(58) Field of Classification Search ..... 206/515, 206/519; 229/4.5, 400, 403
See application file for complete search history.

(56) References Cited

U.S. PATENT DOCUMENTS 2,563,352 A * 8/1951 Morse ..... 206/515
2,602,568 A * 7/1952 Kinney, Jr. ..... 206/519
2,816,697 A 12/1957 Amberg
3,009,603 A * 11/1961 Stockdale ..... 206/519
3,049,277 A * 8/1962 Shappell ..... 229/403
3,358,879 A * 12/1967 Mueller ..... 206/519
3,414,183 A * 12/1968 Wilcox ..... 206/515
3,529,743 A * 9/1970 Ehrbar et al. ..... 206/519
3,612,346 A * 10/1971 Schneider ..... 206/519
3,648,888 A * 3/1972 Cheladze ..... 206/519
3,854,583 A 12/1974 Amberg et al.
3,970,492 A 7/1976 Amberg et al.
3,995,740 A 12/1976 Amberg et al.
4,053,346 A 10/1977 Amberg et al.
4,088,526 A 5/1978 Amberg et al.

(Continued)

FOREIGN PATENT DOCUMENTS

CH 563 889 7/1975

(Continued)

OTHER PUBLICATIONS

Notification of Transmittal of International Search Report dated Sep. 26, 2007 (2 pages) for PCT/EP2007/006095.

(Continued)

*Primary Examiner*—Gary E Elkins
(74) *Attorney, Agent, or Firm*—Flynn, Thiel, Boutell & Tanis, P.C.

(57) ABSTRACT

A cup made of paper material comprises a fillable interior, which is formed by a conical sleeve and a bottom. The bottom is attached with a bottom skirt and essentially liquid-tight to the sleeve at the lower end of the interior. The sleeve comprises at its upper end an outwardly formed lip. The height of the lip is greater than the height of the bottom over the standing surface of the cup at the lower edge of the bottom skirt.

6 Claims, 5 Drawing Sheets

U.S. PATENT DOCUMENTS

| | | | | |
|---|---|---|---|---|
| 4,106,397 | A | 8/1978 | Amberg et al. | |
| 4,197,948 | A | 4/1980 | Amberg et al. | |
| 4,498,585 | A * | 2/1985 | Gordon et al. | 206/519 |
| 4,682,727 | A * | 7/1987 | Stoll | 206/515 |
| 4,836,400 | A * | 6/1989 | Chaffey et al. | 229/400 |
| 2006/0226210 | A1 | 10/2006 | Stahlecker | |

FOREIGN PATENT DOCUMENTS

| | | | |
|---|---|---|---|
| DE | 961 053 | | 3/1957 |
| DE | 1 904 088 | | 9/1969 |
| DE | 31 15 689 | A1 | 1/1982 |
| DE | 297 06 961 | U1 | 9/1998 |
| DE | 10 2005 017 741 | A1 | 10/2006 |
| EP | 1 227 042 | B1 | 7/2002 |
| GB | 191206984 | | 0/1913 |
| GB | 558 436 | | 1/1944 |
| GB | 832 407 | | 4/1960 |
| GB | 2 420 267 | A | 5/2006 |
| JP | 55-134046 | | 10/1980 |
| JP | 08217051 | A | 8/1996 |
| JP | 2001 192015 | | 7/2001 |
| JP | 2003 340943 | | 2/2003 |
| JP | 2003 128038 | A | 5/2003 |
| JP | 2004 -99079 | | 4/2004 |

OTHER PUBLICATIONS

International Search Report of PCT/EP2007/006095 (7 pages).
Written Opinion of International Searching Authority (7 pages) for PCT/EP2007/006095.
Notification of Transmittal of International Search Report dated Sep. 25, 2007 (2 pages) for PCT/EP2007/006094.
International Search Report of PCT/EP2007/006094 (5 pages).
Written Opinion of International Searching Authority (8 pages) for PCT/EP2007/006094.
German Patent Office Search Report dated Mar. 22, 2007 (4 pages).

* cited by examiner

CUP MADE OF PAPER MATERIAL

BACKGROUND AND SUMMARY OF THE INVENTION

The present invention relates to a cup made of paper material comprising a fillable interior, which is formed by a conical sleeve and a bottom, whereby the bottom is attached with a bottom skirt essentially liquid-tight to the sleeve at the lower end of the interior, and whereby the sleeve comprises an outwardly formed lip at the upper end of the sleeve.

Cups of this type are applied with success in the field and used for example for the consumption of beverages. One-walled cups of the above named type are supported during stacking with their standing surfaces at the lower edge of the bottom skirt on the bottom of a cup of the same type. The bottom skirt and the bottom are stressed by the forces which occur during stacking.

It is an object of the present invention to improve the known cup.

This object has been achieved in accordance with the present invention in that the height of the lip is greater that the height of the bottom over the standing surface of the cup at the lower edge of the bottom skirt.

The increased height of the lip causes an advantageously changed appearance of the cup. In addition, the bottom skirt and the bottom are kept free of stress in an advantageous way when a number of cups are stacked together. It can be advantageously provided that the lip comprises a first and a second holding means, which support the cup during stacking against another cup of the same type. The first holding means is advantageously formed by an upper edge of the lip. The second holding means is advantageously formed by a lower edge of the lip.

A double-walled paper cup is known from German published patent application DE 10 2005 017 741 A1, in which the upper edge of the lip forms a first holding means. The second holding means is formed by a shoulder-shaped stacking stopper, which is assigned to the lip. An embodiment of this kind is not suitable for a one-walled cup. The outer sleeve is essential in order to achieve the advantageous stacking properties. The bottom and the bottom skirt of this cup are not subject to stress during stacking, the outer wall however is stressed in this case by the forces occurring during stacking.

In the case of the cup according to the present invention, the good stacking ability is independent of the presence of an outer sleeve. In an embodiment of the present invention it can be provided that the cup comprises an outer sleeve. If provided that a heat-insulating outer sleeve is arranged to the cup, this outer sleeve can be designed to a great extent as wished without influencing the stacking properties. The forces occurring during stacking simply are relayed within the lip. If an outer sleeve is provided, it is not stressed by the forces occurring during stacking.

The design of an optional heat-insulating outer sleeve can take any chosen form. The outer sleeve can, for example, be produced from synthetic, paper or composite material. In order to improve the insulating effect, the outer sleeve can also be corrugated, fluted, embossed or comprise a foamed coating. The outer sleeve can also be multilayered, for example a corrugated middle layer can be provided which is covered by a flat outer layer disposed thereon. As the cup according to the present invention can be stacked independently of the outer sleeve, the same cup can be simply combined in almost any way with a large variety of outer sleeves. Without altering the form and dimensions of the inner cup or of the lip, a variety of cups having different optical and haptical appearances can be created, as the outer appearance, as perceived by the user of the cup, is determined essentially by the design of the outer sleeve.

During the production process, the cup according to the present invention can be stacked at this stage in a secure and stable manner as a semi-finished product when the finished inner cup has to be stacked before the outer sleeve is applied in a subsequent process.

In the case of cups made of paper material, the bottom skirt is a very important element of the cup. The bottom skirt is necessary for joining the sleeve and the bottom. At least two material layers are disposed in thickness direction on top of one another, namely the material of the bottom and the material of the interior-defining sleeve. The bottom is advantageously pot-shaped, the open side of said bottom facing away from the filling opening of the cup. The at least two material layers are advantageously arranged along the wall of the pot-shaped bottom. It can be additionally provided, for example, that the sleeve is folded inwards around the material of the bottom, and that the bottom skirt consists of three or more material layers. The material of the bottom is glued or sealed to the material of the sleeve in the area of the bottom skirt, in order that it is liquid-tight for at least a certain time.

The term "paper material", from which the bottom and the sleeve are made, includes various material, which comprise at least one layer of paper, paperboard or cardboard. In addition the material can comprise one or more layers made of synthetics and/or aluminium. It can also be provided that the paper material is waxed or coated, in order to provide a resistance against the liquid with which the cup is subsequently filled. The paper material is advantageously coated at least on the side facing the interior with a thin synthetic layer, preferably made of polyethylene. In contrast to purely synthetic material, the formability and in particular the ductibility of such paper material is limited. In the case of too great a deformation, the paper material itself, or a provided coating, may tear, so that the liquid-tight properties are impaired. The bottom skirt is therefore an essential design feature in the case of cups made of paper material and cannot be omitted, and care must be taken that the liquid tightness is not impaired in any way. The lip is, in contrast, significantly less critical as regards the liquid tightness. The lip is formed on the upper edge of the sleeve forming the interior, in that the sleeve is formed outwards and rolled in. The formed areas of the material of the sleeve lie after formation of the lip essentially on the outer side of the cup, which does not actually come into contact with the liquid to be filled. If a tear occurs in the coating of the sleeve during formation of the lip, this has virtually no effect on the liquid tightness of the cup.

It can be advantageous that the material of the sleeve in the area of the upper edge is heated up before and/or during the formation of the lip. Heating up can take place for example by means of blowing the sleeve with hot air, or by means of a heated forming tool. The temperature is advantageously so chosen that any synthetic layer present in the paper material does not reach its melting point, but rather just becomes somewhat softer.

With the lip according to the present invention, very stable stacks having a high number of cups can form, which do not wedge inside one another either when the stack is subjected to knocks or for example is set abruptly down on the ground.

BRIEF DESCRIPTION OF THE DRAWINGS

These and further objects, features and advantages of the present invention will become more readily apparent from the following detailed description thereof when taken in conjunction with the accompanying drawings. Individual features of the various embodiments shown and described can be combined as required without exceeding the scope of the present invention.

DETAILED DESCRIPTION OF THE DRAWINGS

Figure 1:
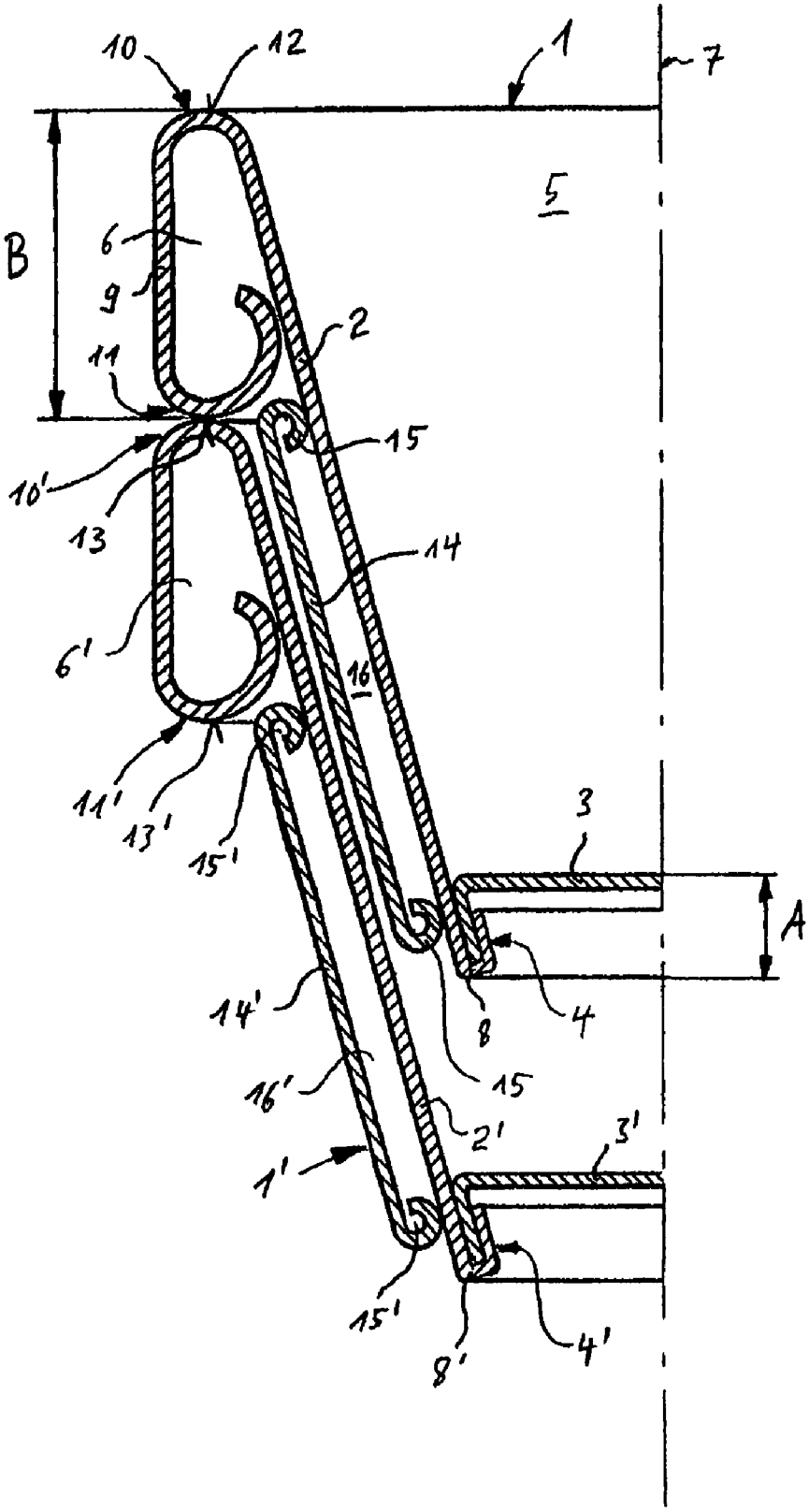
FIG. 1 show two stacked cups according to the present invention in longitudinal section, whereby in the view, the area lying on the other side of the middle line is omitted.

The cup 1 shown in FIG. 1 consists essentially of a conical sleeve 2 and a pot-shaped bottom 3. The open side of the pot-shaped bottom 3 is arranged in such a way that it is facing away from the filling opening of the cup 1. The bottom 3 is attached liquid-tight with its wall 31 to the sleeve 2 in the area of its smallest diameter by means of a bottom skirt 4. In the area of the bottom skirt 4, the material of the sleeve 2 is placed around the wall 31 of the bottom 3 and folded inwards. The sleeve 2 and the bottom 3 form a fillable interior 5 of the cup 1. The sleeve 2 defining the interior 5 comprises on its top edge, that is, in the area of its largest circumference, an outwardly rolled lip 6, which surrounds the filling opening. The "conical" feature of the sleeve 2 is hereby to be understood in that the sleeve 2 tapers in longitudinal section as shown in FIG. 1 from the lip 6 to the bottom 3. The sleeve 2 comprises hereby in the area of the fillable interior 5 an angle of inclination to the line of symmetry or the middle axis 13 of the cup 1. The form of the sleeve 2 in cross section is hereby irrelevant. The sleeve 2 may be circular, oval or even rectangular with rounded edges in cross section. In the case of a round cross section of the conical sleeve 2, the cup 1 has a truncated cone shape, while in the case of a rectangular cross section, the conical sleeve 3 has a truncated pyramid shape.

At the lower edge 8 of the bottom skirt 4, a standing surface for the cup 1 is located. The cup 1 stands on its standing surface at the lower edge 8 during use. The bottom 3 has a height A over the standing surface of the cup 1 at the lower edge 8 of the bottom skirt 4. The height A is advantageously so chosen that the bottom 3 can be well attached to the sleeve 2 and in a liquid-tight way, and that the necessary stability of the standing surface is ensured. The lip 6 has—parallel to the middle axis 7—a height B, which is greater than the height A. In order to change the outward appearance of the cup 1, the outer area 9 of the lip 6 can be designed in various ways. The area 9 is advantageously cylindrical as shown in FIG. 1, so that the outer surface, as seen in longitudinal section, extends virtually parallel to the middle axis 7. In an embodiment not shown, it can also be provided that the outer area 9 of the lip 6 extends for example parallel to the sleeve 2 or also that the outer area 9, as seen in longitudinal section, is convexly designed.

As the height B is greater than the height A, the bottom 3 and the bottom skirt 4 is not stressed by forces when the cup 1 is stacked with a cup 1' of a similar type.

The lip 6 comprises a first means 10 and a second means 11 for holding a cup 1' of a similar type. In the example shown, the first means 10 is formed by the upper edge 12 of the lip 6. The lower edge 13 of the lip 6 forms a second means 11 for holding another cup 1' of a similar type. Due to the corresponding formation of the lip 6 of the cup 1, the lower edge 13 can be supported against an upper edge 12' of the lip 6' of a cup 1' of a similar type when stacked. The forces which occur along the middle axis 7 during stacking, for example the forces of weight of the cup 1 and the cups possibly stacked above, are only passed on through the sleeve 2 in the area of the lip 6. Even if very strong forces occur in the direction of the middle axis 13, an easy removal of the cup 1 or 1' when de-stacking is ensured.

When the upper edge 12 of the lip 6 is designed as a first means 10 for holding and the lower edge 13 as a second means 11 for holding, the stacking of a number of cups 1, 1' is only possible when the height A is less than the height B, as otherwise the lower edge 8 of the bottom skirt 4 would touch the bottom 3'.

In FIG. 1, an outer sleeve 14 is arranged to the cup 1, which outer sleeve 14, however, is not absolutely necessary. The outer sleeve 14 is not required when the cups 1 and 1' are stacked. In the shown case, the sleeve 2 defining the interior 5 has a smooth-surfaced design along the entire length of its conicity. The outer sleeve 14 comprises both at its upper and at its lower end a curled-in part 15, with which it is supported on the sleeve 2 defining the interior. The heat-insulating outer sleeve 14 surrounds the sleeve 2 defining the interior at least partly while forming a hollow space 16. A cup of this type is also known as a double-walled insulating cup, in which the sleeve 2 located within the outer sleeve 14 in connection with the bottom 3 is can also be denoted as an "inner cup". Attaching the outer sleeve 14 to the inner cup can hereby take place by means of sealing or gluing. It effects a secure connection between the outer sleeve 14 and the sleeve 2 defining the interior 5, so that a slippage of the outer sleeve 14 is reliably prevented. The height of the outer sleeve 14 can be chosen according to requirements and can by all means differ from the shown height. The outer sleeve 14 can be chosen shorter or longer than in the shown embodiment. As the stacking properties are not determined by the outer sleeve 14, it can be designed virtually without restrictions.

Figure 2:
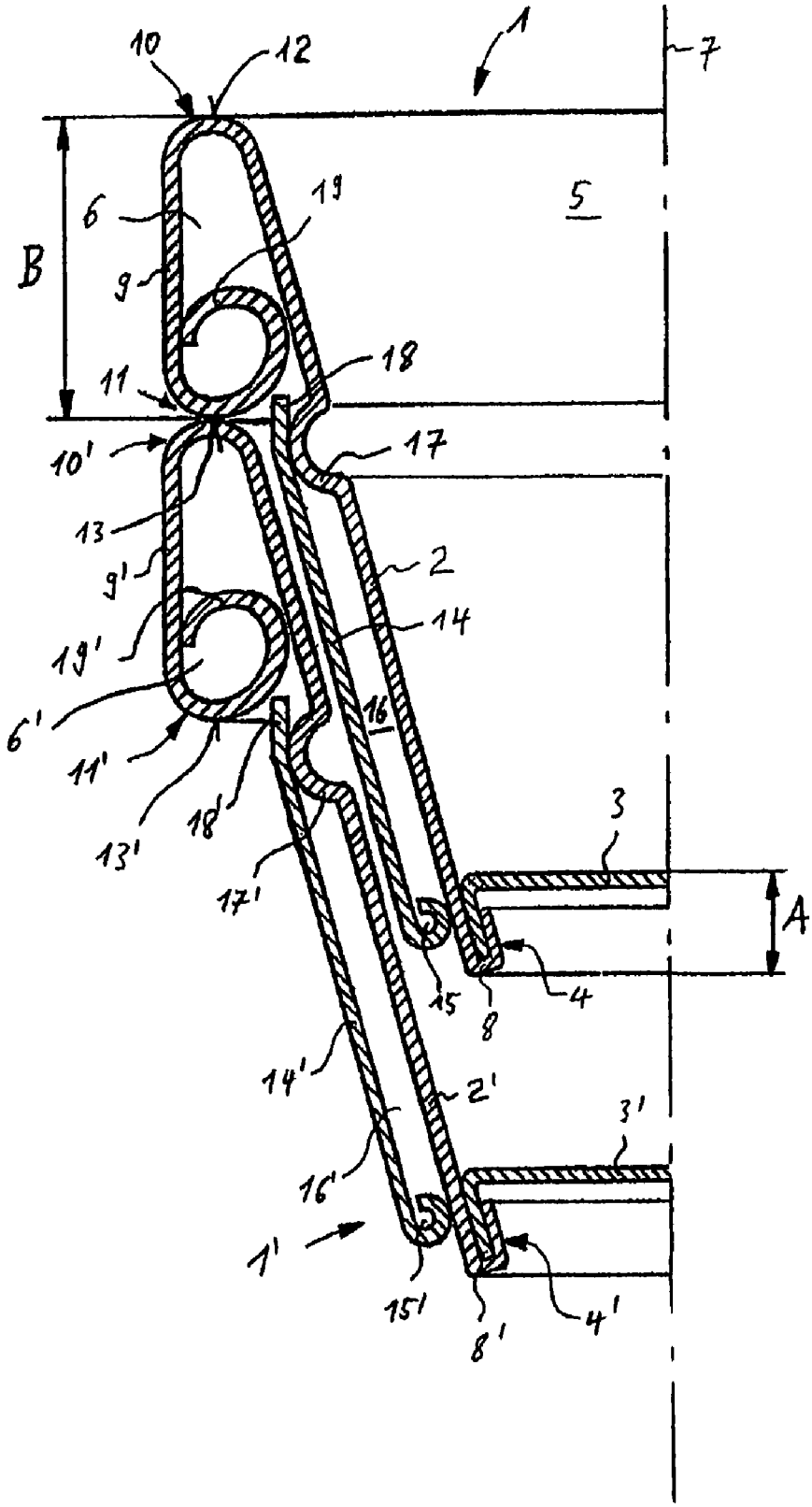
FIGS. 2 to 5 show views similar to FIG. 1 of cups of various designs.

In FIG. 2 the sleeve 2 defining the interior in the area below the lip 6 comprises a bead or a rib 17. The outer sleeve 14 lies, in the area of the largest diameter, on the rib 17 and as a result is at a distance to the sleeve 2. The upper edge area 18 of the outer sleeve 14 can be somewhat compressed. The edge area 18 does not continue the conical outer sleeve 14 homogenously, but rather comprises a slightly tapering diameter. The upper edge of the outer sleeve 14 can thus be very easily slid in up to under the lip 6. The rib 17 does not need to encompass the sleeve 2 completely, but rather can very advantageously consist of only selected stamped areas in the sleeve 2. At its lower end, the outer sleeve 14 is supported in turn with a curled-in part 15 at the sleeve 2. In the case of the lip 6 in FIG. 2, somewhat more material of the sleeve 2 is curled inwards in the area 19, so that the stability of the lip is increased. In other respects, the reference numbers denote the same parts of the cup 1 as in FIG. 1, so that a repeat description is not necessary.

Figure 3:
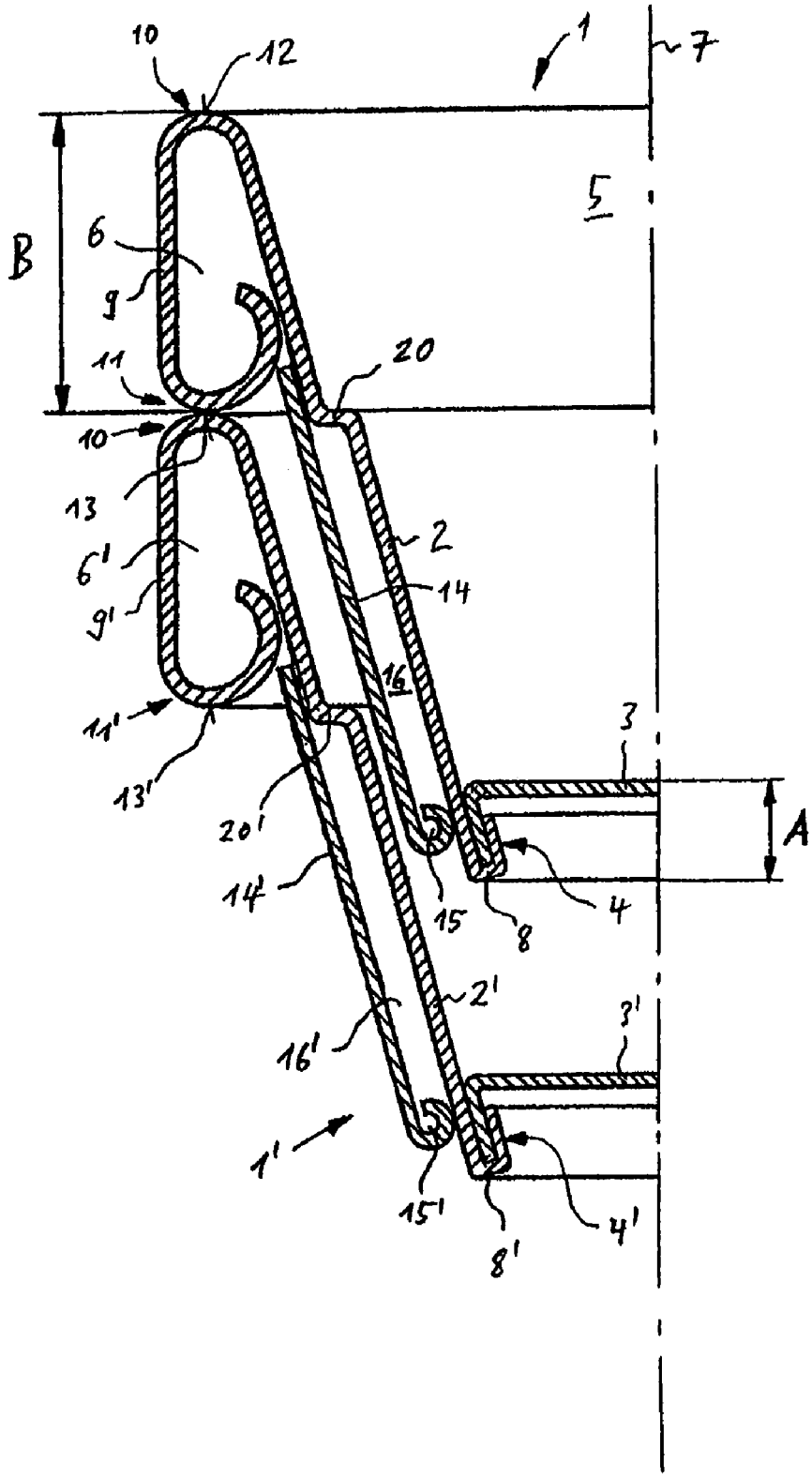

FIG. 3 shows a variation of the cup 1, in which the sleeve 2 defining the interior 5 comprises an abrupt change in size in the form of a shoulder 20 in the area below the lip 6, which shoulder 21 presents itself as an abrupt increase of the cross section when seen from the bottom 3 to the lip 6. The outer sleeve 14 is attached in the area between the lip 6 and the shoulder 20 to the sleeve 2 defining the interior 5, for example by means of sealing or gluing. At its lower end the outer sleeve 14 comprises an inwardly rolled curled-in part 15.

The outer sleeves 14 shown in FIGS. 1 to 3 have the advantage in that they permit a very wide hollow space 16 between sleeve 2 and outer sleeve 14 to occur virtually along the entire height of the cup 1, which hollow space 16 has a very high insulating effect.

Figure 4:
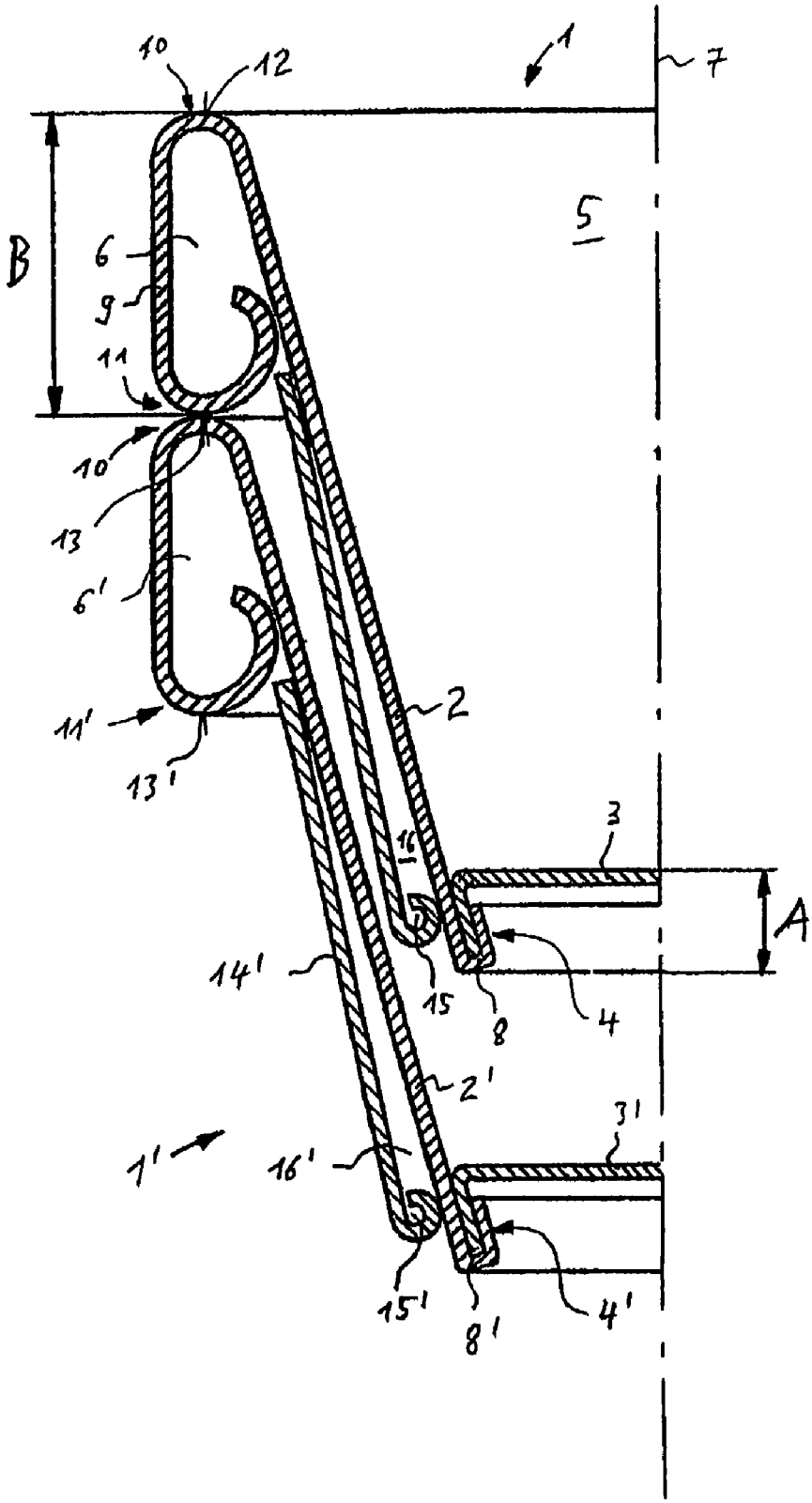

FIG. 4 shows a variation of the cup 1, in which the outer sleeve 14 in the area below the lip 6 is disposed directly on the smooth-surfaced sleeve 2. The hollow space 16 between the sleeve 2 and the outer sleeve increases in the direction towards the bottom skirt 4. At the lower end, the outer sleeve 14 is disposed in turn with an inwardly curled-in part 15 on the sleeve 2. It can alternatively be provided, to seal the outer sleeve 14 at its lower end flush with the smooth-surfaced sleeve 2 and to apply an curled-in part at the upper edge, so that the hollow space 16 tapers from the top downwards.

Figure 5:
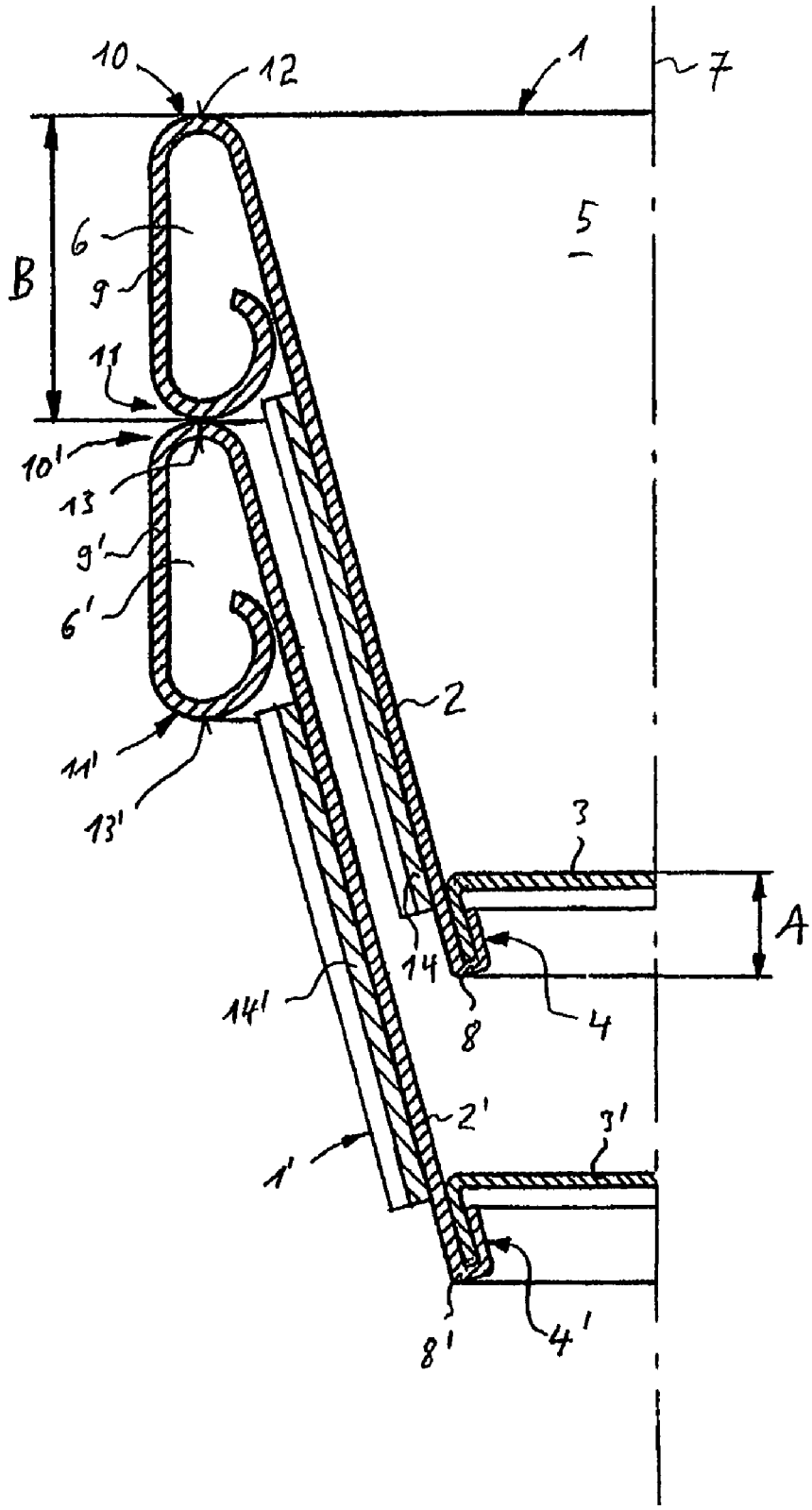

In FIG. 5 a variation of the cup 1 is shown, in which the outer sleeve 14 is disposed on the sleeve 2 essentially without a hollow space. This embodiment has the advantage in that the stability of the sleeve 2 is enlarged by the outer sleeve 14. In particular in this case, a foam layer can be applied to the outer side of the outer sleeve 14 in order to increase the insulating effect.

When the level of the insulating effect is to be changed, it can be provided in an embodiment not shown that the outer sleeve 14 has a corrugated, fluted or embossed design, or is designed with a foam layer. It can also be advantageous to apply foamed layers or corrugated paper layers within the hollow space 16.

The invention claimed is:

1. A cup made of paper material comprising a fillable interior, which is formed by a conical sleeve and a bottom, whereby the bottom is attached with a bottom skirt essentially liquid-tight to the sleeve at the lower end of the interior, said bottom skirt forming a standing surface at its lower end and whereby the sleeve comprises an outwardly formed lip at the upper end of the sleeve, wherein the height (B) of the lip is greater than the height (A) of the bottom over the standing surface of the cup at the lower edge of the bottom skirt and wherein said outwardly formed lip has an outwardly rolled upper edge and an inwardly rolled lower edge, wherein an upper edge of said conical sleeve is rolled for an angle of at least 360 degrees so that the outwardly formed lip has a section being parallel to an outside of the conical sleeve and resting thereon, and wherein the lip comprises a first and second holding means, which support the cup when stacked with another cup of the same type.

2. A cup according to claim 1, wherein the cup comprises an outer sleeve.

3. A cup according to claim 2, wherein an upper edge of the outer sleeve is arranged in a space defined between a lower edge of the outwardly formed lip and the outside of the conical sleeve.

4. A cup according to claim 1, wherein, in the area where the outwardly formed lip rests on the outside of the conical sleeve, the conical sleeve tapers in a direction of the bottom of the cup and wherein an outside of the outwardly formed lip has a cylindrical section being parallel to a center line of the cup.

5. A cup according to claim 1, wherein, in an area where the outwardly formed lip rests on the outside of the conical sleeve, the conical sleeve tapers in a direction towards the bottom of the cup and wherein an outside of the outwardly formed lip, when seen in a section along the center line of the cup, is convexly to the outside.

6. A cup according to claim 1, wherein, during forming said outwardly formed lip, an upper edge of the conical sleeve is rolled for an angle of approximately 540 degrees so that the outwardly formed lip has a section extending from the outside of the conical sleeve to an inside of an outer section of the outwardly formed lip.

* * * * *